United States Patent [19]

Giere

[11] Patent Number: 4,934,252

[45] Date of Patent: Jun. 19, 1990

[54] VARIABLE DISPLACEMENT PUMP OR MOTOR AND NEUTRAL CENTERING MECHANISM THEREFOR

[75] Inventor: David W. Giere, Chaska, Minn.

[73] Assignee: Eaton Corporation, Cleveland, Ohio

[21] Appl. No.: 321,825

[22] Filed: Mar. 9, 1989

[51] Int. Cl.[5] ..... F01B 13/06; F16H 21/44

[52] U.S. Cl. ..... 91/497; 74/523; 74/526

[58] Field of Search ..... 91/496, 497, 498; 92/12.1; 417/462; 74/523, 526

[56] References Cited

U.S. PATENT DOCUMENTS

| | | | |
|---|---|---|---|
| 3,374,629 | 3/1968 | Catuara et al. | 60/53 |
| 3,831,497 | 8/1974 | Trabbic et al. | 91/497 |
| 3,967,541 | 7/1976 | Born et al. | 92/12.2 |
| 4,111,062 | 9/1978 | Callaghan | 74/96 |

*Primary Examiner*—Leonard E. Smith
*Assistant Examiner*—John A. Savio, III
*Attorney, Agent, or Firm*—L. J. Kasper

[57] ABSTRACT

A neutral centering mechanism (15) is disclosed of the type which may be used with a variable pump (11) of the type including a control shaft (33) rotatable about its axis of rotation (35) from a neutral position to first and second operating positions (FIGS. 12 and 13). A control handle (61) is rotatably fixed to the control shaft. The centering mechanism includes a stop plate (41) defining a fixed stop surface (43) and a spring plate (49) which is rotatable about the axis of rotation and defines a movable stop surface (79) in engagement with the handle (61) in the neutral position. The stop plate includes an adjustment screw (45) which adjusts the rotational position of the spring plate to a position in which the movable stop surface is disposed for neutral centering of the control handle and control shaft. A spring (59) biases the handle toward the movable stop surface, when the handle is rotated away from neutral to a first operating position. Another spring (51) biased the spring plate toward the fixed stop surface when the handle and spring plate are rotated, together, away from neutral to a second operating position. As a result, the neutral centering mechanism of the invention will always return the control handle and the control shaft to absolute neutral, independent of the manufacturing tolerances of the various parts of the mechanism.

8 Claims, 5 Drawing Sheets

VARIABLE DISPLACEMENT PUMP OR MOTOR AND NEUTRAL CENTERING MECHANISM THEREFOR

BACKGROUND OF THE DISCLOSURE

The present invention relates to neutral centering mechanisms, and more specifically, to such mechanisms for use in returning the controls of a variable displacement hydraulic device from one of first and second operating positions, back to a neutral position.

Hydrostatic transmissions typically include variable displacement pump units, which include a fluid displacement mechanism, and some means operable to vary the displacement of the displacement mechanism in response to rotation of an input control member or control shaft.

Such variable displacement pump units are typically of the "over-center" type, i.e., the displacement mechanism may be displaced from the neutral position to either a first operating position (e.g., forward), or in the opposite direction, to a second operating position (e.g., reverse). In such devices, it has proven to be very difficult to design and manufacture commercially acceptable control devices, by means of which the control shaft of the pump may be returned from either the first or second operating position to "absolute neutral", i.e., a position of the control shaft corresponding to a zero displacement of the pump.

As is well known to those skilled in the art, one of the primary difficulties in designing and manufacturing such controls is that, typically, the ability of the neutral centering portion of the control to return the control shaft to absolute neutral is highly dependent upon the ability to maintain very close manufacturing tolerances on one or more of the parts of the neutral centering mechanism.

Another problem which has arisen with many such neutral centering mechanisms, for use in devices such as over-center pumps, is the need to make two or more separate adjustments within the centering mechanism, thereby compounding the tolerance sensitivity of the mechanism.

SUMMARY OF THE INVENTION

Accordingly, it is an object of the present invention to provide an improved neutral centering mechanism, for use on devices such as over-center hydraulic pumps, in which the ability of the mechanism to return the control member to an absolute neutral position is substantially independent of the manufacturing tolerances of the various parts of the mechanism.

It is a more specific object of the present invention to provide an improved neutral centering mechanism which defines a single, movable stop surface which may be adjusted to absolute neutral, and which is in engagement with a control handle upon return to neutral, from either the first or second operating position.

The above and other objects of the present invention are accomplished by the provision of an improved neutral centering mechanism operably associated with a control shaft which is rotatable about an axis of rotation from a neutral position to a first operating position, and from the neutral position to a second operating position. A control handle is rotatably fixed to the control shaft whereby rotational actuation movement of the control handle about the axis of rotation results in corresponding rotation of the control shaft. The neutral centering mechanism is operable to return the control handle and control shaft to the neutral position from either the first operating position or the second operating position. The improved neutral centering mechanism is characterized by means defining a fixed stop surface, and a spring plate rotatable about the axis of rotation, disposed adjacent the control handle, and defining a movable stop surface. The spring plate includes a portion in engagement with the fixed stop surface. The rotational position of the spring plate, about its axis of rotation, is adjustable to a position in which the movable stop surface is disposed for neutral centering of the control handle and the control shaft. The mechanism includes first biasing means associated with the spring plate and with the control handle, and operable to bias the control handle toward the movable stop surface when the control handle has been rotated away from the movable stop surface to the first operating position. The mechanism further includes second biasing means associated with the spring plate, and operable to bias the spring plate toward the fixed stop surface when the control handle has been rotated away from the neutral position to the second operating position, thereby causing the spring plate to rotate away from the fixed stop surface.

DESCRIPTION OF THE PREFERRED EMBODIMENT

Figure 1:
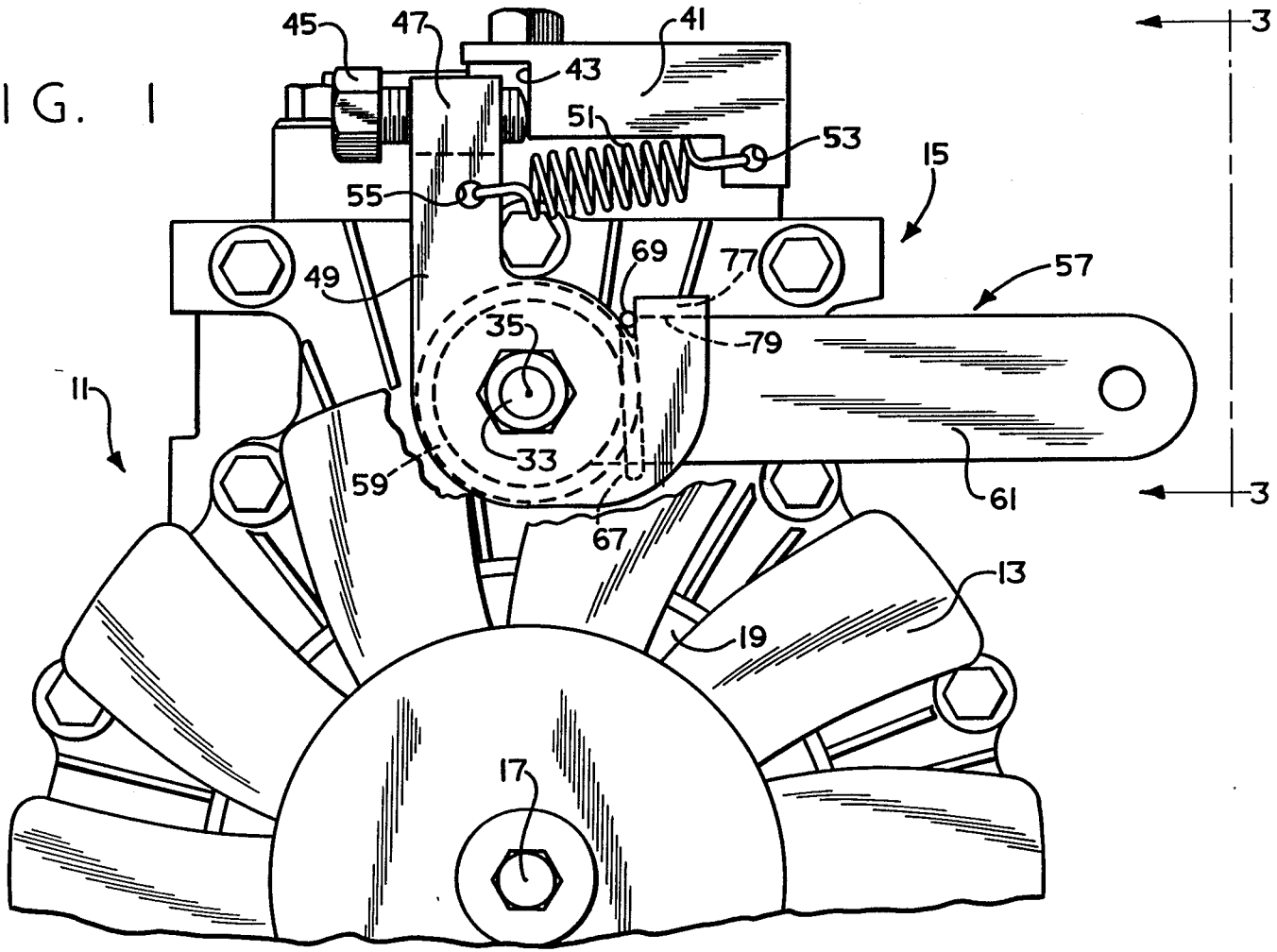
FIG. 1 is a fragmentary, top plan view of a variable displacement, radial ball pump, in its neutral position, including the novel neutral centering mechanism of the present invention.

Referring now to the drawings, which are not intended to limit the present invention, FIG. 1 illustrates a fragmentary, top plan view of a variable displacement hydraulic pump, generally designated 11, of the type with which the present invention may be utilized. Disposed forwardly of the pump 11 is a cooling fan 13, several of the fan blades being shown fragmentarily to expose a neutral centering mechanism, generally designated 15.

In the subject embodiment of the present invention, the cooling fan 13 is mounted on an input shaft 17, which provides the input drive to the pump 11. Disposed between the pump 11 and the fan 13 is a driven pulley 19 which receives input drive torque from the vehicle engine (not shown) by means of a V-belt (also not shown).

Figure 2:
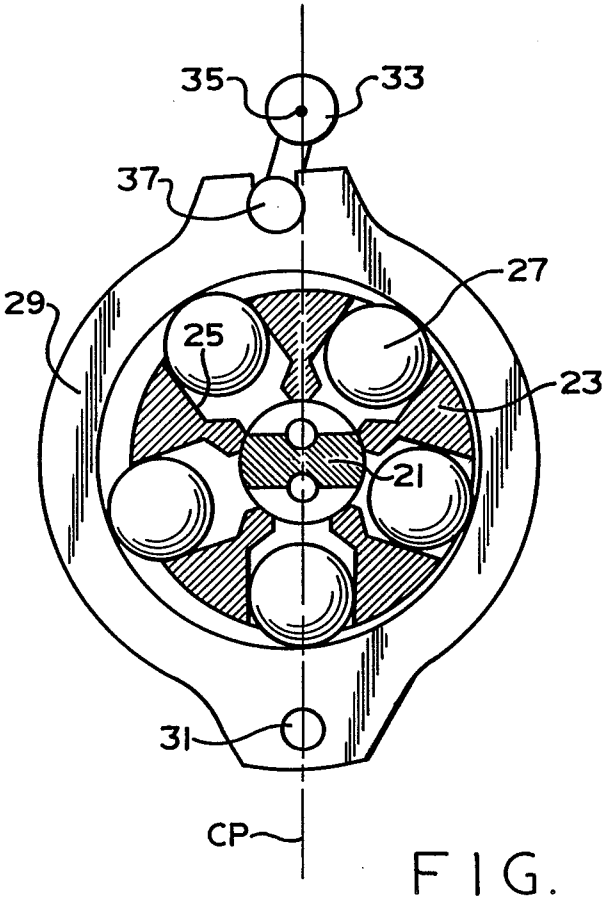
FIG. 2 is a somewhat schematic view, looking in the same direction as FIG. 1, but on a smaller scale than FIG. 1, illustrating the displacement varying mechanism of the pump of FIG. 1.

Referring now to FIG. 2, there is illustrated somewhat schematically the fluid displacement mechanism utilized in the subject embodiment of the pump of FIG. 1. The mechanism includes a pintle 21 on which is mounted a rotor 23, defining a plurality of radially oriented cylinders 25. Disposed in each of the cylinders 25 is a radially reciprocable ball member 27. The rotor and ball assembly is surrounded by a cam ring 29 which is mounted for pivotal movement about an anchor pin 31. As is well known to those skilled in the art, if the cam ring 29 is concentric relative to the rotor 23, the fluid displacement of the pump shown in FIG. 2 is zero, also referred to as the "neutral" position. If the cam ring 29 is displaced from the neutral position to an operating position such as that shown in FIG. 2, there will be a net fluid displacement as the rotor 23 makes one complete revolution. Varying the displacement of the cam ring 29 is accomplished by means of a control shaft 33, which is rotatably supported within the housing of the pump 11 such that it rotates about its axis of rotation 35. Rotation of the control shaft 33 causes side-to-side movement in FIG. 2 of a pivot member 37, which is received in a semi-circular opening in the cam ring 29.

Figures 3, 4:
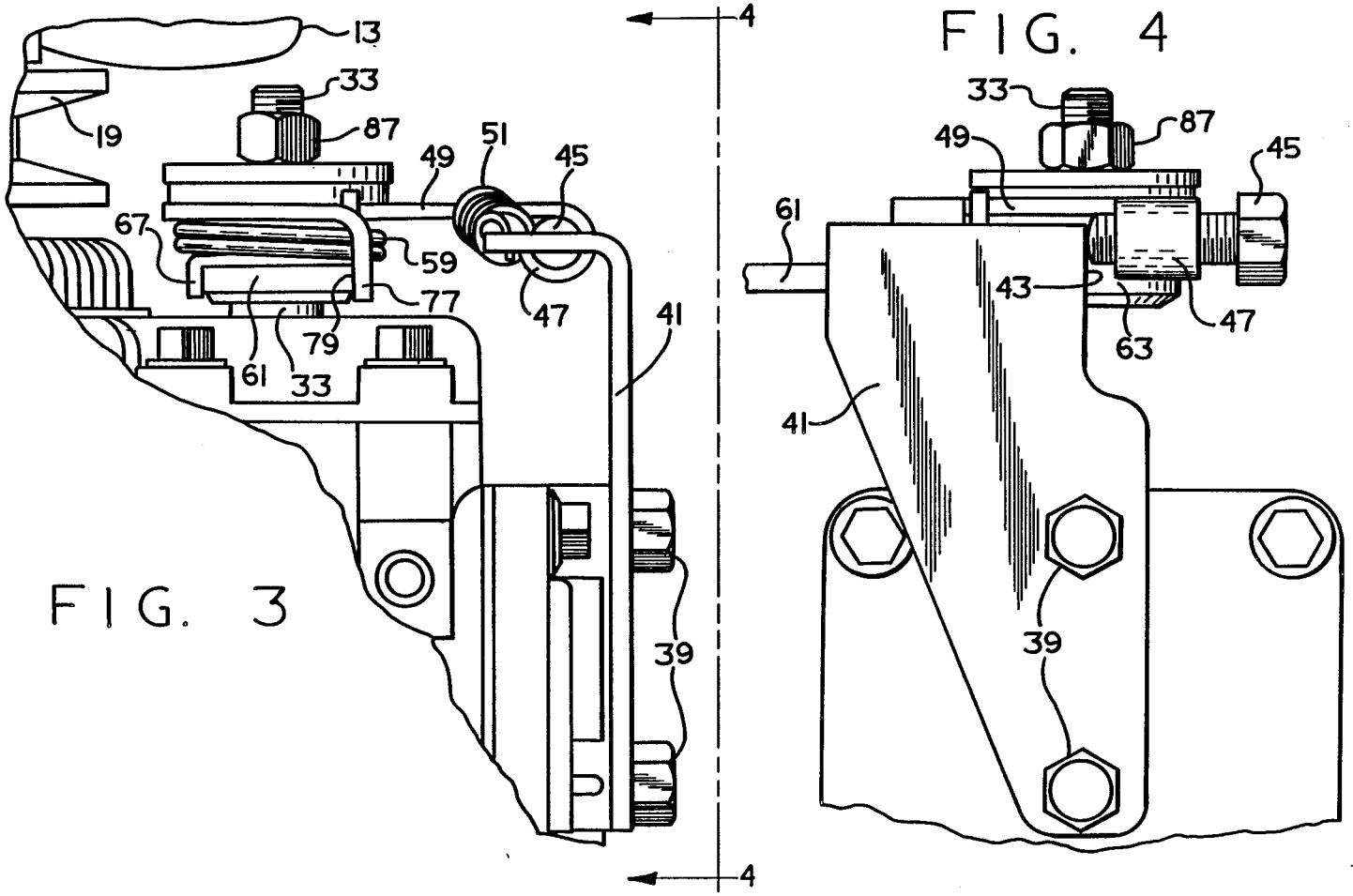
FIG. 3 is a fragmentary, side elevation, taken on line 3—3 of FIG. 1, of the neutral centering mechanism of the present invention.
FIG. 4 is a fragmentary plan view, taken on line 4—4 of FIG. 3, and on the same scale.
Figure 6:
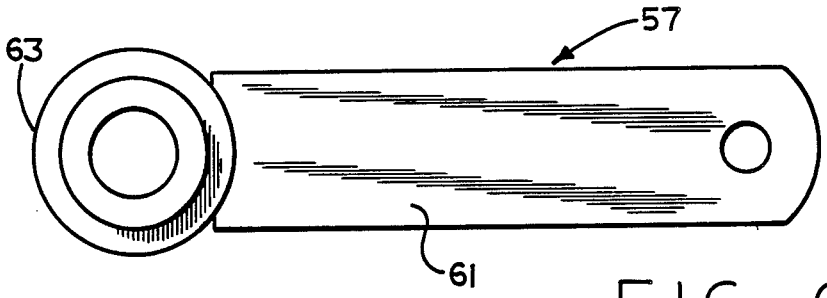
FIGS. 6–11 are top plan views, all on the same scale, of individual parts of the neutral centering mechanism of the present invention, illustrated in the order in which they are arranged on the control shaft of the pump.

Referring now primarily to FIG. 1, in conjunction with FIGS. 3 and 4, the neutral centering mechanism 15 of the present invention will be described generally. Attached to the forward portion, by means of a plurality of bolts 39 is a stop plate 41, which defines a fixed stop surface 43 (see FIGS. 1 and 4). Disposed in engagement with the fixed stop surface 43 is a neutral adjustment screw 45, which is in movable, threaded engagement with a loop portion 47 (best seen in FIG. 3), formed integrally as part of a spring plate 49. Spring plate 49 is biased toward the neutral position shown in FIGS. 1 and 4 by means of a coiled extension spring 51. The spring 51 has its right end (in FIG. 1) in engagement with a hole 53 defined by the stop plate 41, and its left end in FIG. 1 in engagement with a hole 55 defined by the spring plate 49.

Figure 5:
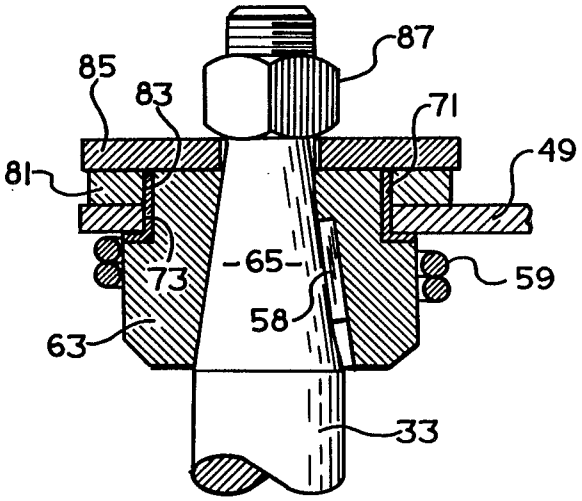
FIG. 5 is a fragmentary, axial cross-section, similar to FIG. 3 but on a larger scale.
Figure 7:
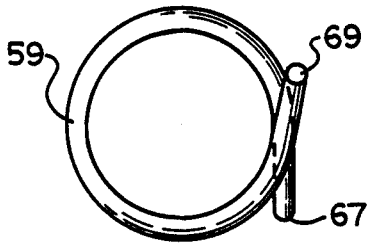
Figure 8:
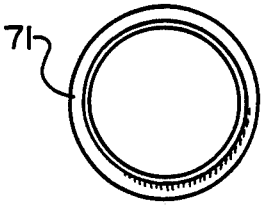
Figure 10:
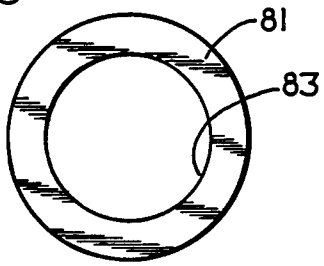
Figure 9:
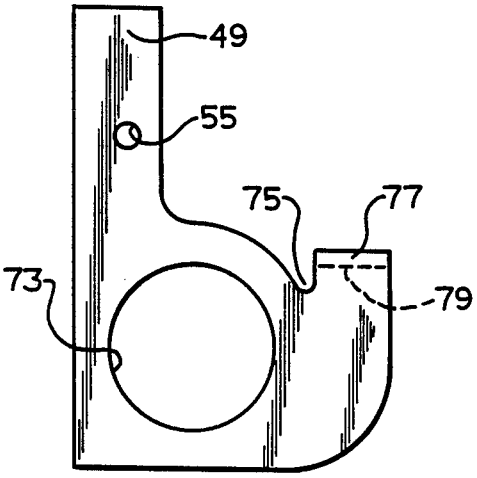
Figure 11:
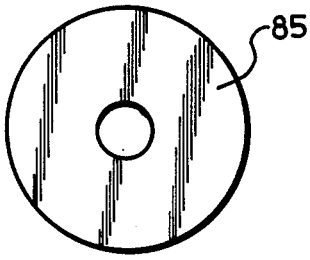

Referring now primarily to FIG. 1, the neutral centering mechanism 15 further includes a control handle assembly 57, which is rotationally fixed, relative to the control shaft 33, by any suitable means such as a key 58 (shown only in FIG. 5). As will be described in greater detail subsequently, clockwise rotation of the control handle 57, from the neutral position shown in FIG. 1, results in displacement of the cam ring 29 to the eccentric position shown in FIG. 2, on the left side of a central plane CP. Similarly, counterclockwise rotation of the control handle assembly 57, from the neutral position shown in FIG. 1, results in movement of the cam ring 29 to an eccentric position on the opposite side of the central plane CP. The control handle assembly 57 is biased toward the neutral position shown in FIG. 1 by means of a torsion spring 59, shown only in dotted form in FIG. 1, but shown also in FIG. 7.

Referring now primarily to FIG. 5, in conjunction with FIGS. 6–11, those parts which are disposed on the outer end of the control shaft 33 will now be described in some detail. The control handle assembly 57 includes a handle member 61, and a generally cylindrical insert member 63, the handle 61 and insert 63 preferably being welded together. As may best be seen in FIG. 5, the insert member 63 is received on a tapered portion 65 of the control shaft 33. The tapered portion 65 is provided partially to insure proper axial position of the insert member 63 on the control shaft 33, in view of the fact that the control handle assembly 57 is the first item placed on the shaft 33.

The torsion spring 59 (FIG. 7) is then put in place about the insert member 63, the spring 59 including an end portion 67 (see FIGS. 1 and 3) which engages a side surface of the handle member 61. The torsion spring 59 also defines an end portion 69, which will be referred to subsequently.

A bushing 71 (FIG. 8) is then inserted on the reduced diameter portion of the insert member 63, with the fit between the bushing 71 and the insert 63 preferably being somewhat loose. Next, the spring plate 49 (FIG. 9) is added, the spring plate 49 defining a central aperture 73, which is lightly pressed onto the outer diameter of the bushing 71, such that the spring plate 49 and bushing 71 are able to rotate together, relative to the insert member 63. The spring plate 49 defines a small notch 75, and during assembly, the end portion 69 of the torsion spring 59 is hooked in place in the notch 75, for reasons to be explained subsequently. The spring plate 49 also includes a downwardly-turned tab portion 77 (see FIG. 3) which defines a movable stop surface 79. The stop surface 79 is referred to as "movable" for reasons which will become apparent in connection with the subsequent description of FIGS. 12 and 13.

A thrust bushing 81 (FIG. 10), defining a central aperture 83 is then placed against the spring plate 49, surrounding the bushing 71. Next, a washer 85 (FIG. 11) is placed over the threaded end of the control shaft 33, against the adjacent surface of the insert member 63, and finally, a nut 87 is threaded onto the end of the control shaft 33 and tightened to bring the washer 85 into tight axial engagement against the insert member 63. However, there is axial clearance between the thrust bushing 81 and spring plate 49, so that the spring plate 49 can rotate freely, relative to the washer 85 and insert member 63.

OPERATION

Referring again briefly to FIG. 1, the neutral centering mechanism 15 may be adjusted to the neutral position shown in FIG. 1 simply by rotating the neutral adjustment screw 45, one way or the other, as required, which in turn rotates the spring plate 49, control handle assembly 57, and control shaft 33, until the cam ring 29 is adjusted to an absolute neutral (zero displacement), as evidenced by the absence of any output flow from the pump 11.

Figure 12:
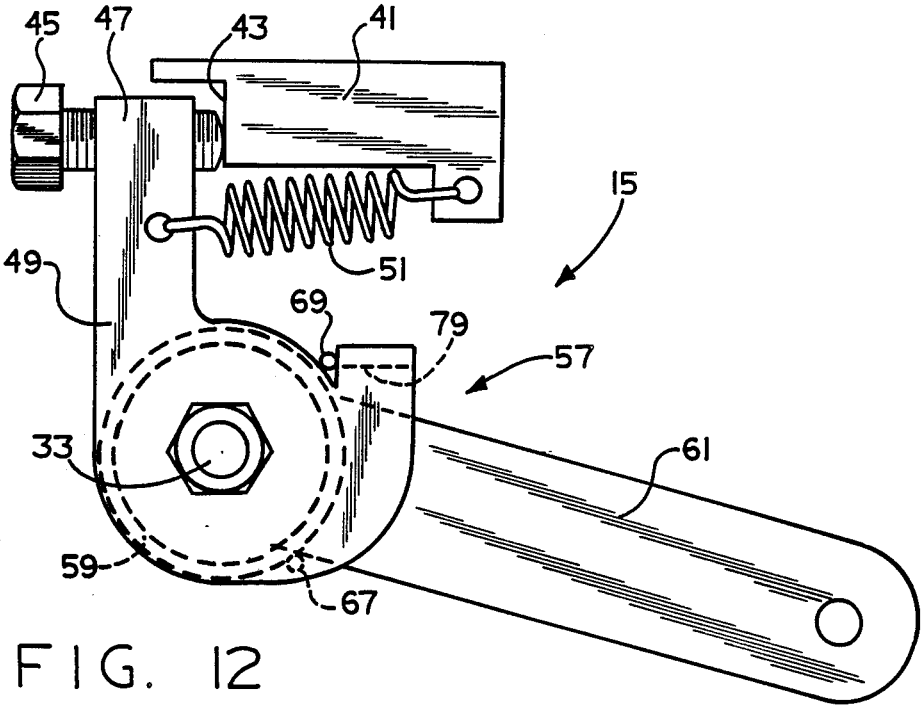
FIGS. 12 and 13 are top plan views, similar to FIG. 1, but showing only the neutral centering mechanism of the present invention, and illustrating it displaced to first and second operating positions, respectively.

Referring now to FIG. 12, the handle member 61 has been rotated approximately 15 degrees clockwise, corresponding to the maximum displacement of the pump 11, in the subject embodiment. As the handle member 61 is rotated clockwise, only the control handle assembly 57 (including the handle 61 and insert 63) and the control shaft 33 rotate clockwise. All other parts of the centering mechanism 15 remain in the neutral position of FIG. 1. The engagement of the neutral adjustment screw 45 and fixed stop surface 43 prevent the spring plate 49 from rotating, and therefore, the movable stop surface 79 also stays in its "neutral" position as shown in FIG. 1. As the handle member 61 moves clockwise to the position shown in FIG. 12, it does so against the bias of the torsion spring 59, and when the handle member 61 is released, the torsion spring 59 will return the handle member 61 to engagement with the stop surface 79, which is known to be an absolute neutral position because of the neutral adjustment previously described.

Figure 13:
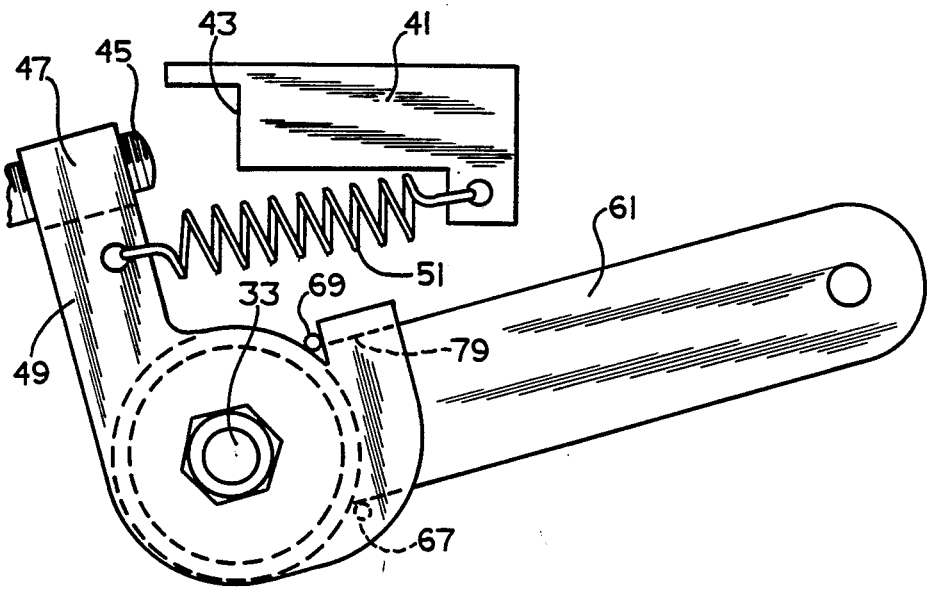

Referring now to FIG. 13, the handle member 61 has been rotated approximately 15 degrees in the counterclockwise position. With the handle member 61 in engagement with the movable stop surface 79, such rotation of the handle member 61 also causes rotation of the spring plate 49, and all the other parts of the centering mechanism 15 to the position shown in FIG. 13. Such rotation of the spring plate 49 is in opposition to the biasing force of the extension spring 51, such that, upon release of the handle member 61, the entire mechanism 15 is returned by the force of the spring 51 to the absolute neutral position shown in FIG. 1, with the adjustment screw 45 again engaging the stop surface 43.

It may now be better understood why the stop surface 79 is referred to as being "movable". In the clockwise direction of rotation of the handle 61, the stop surface 79 remains stationary and serves as a true stop surface, as the handle 61 is returned to absolute neutral. For rotation in the counterclockwise direction, however, the stop surface 79 remains in engagement with, and moves with, the handle 61. In either case, upon release of the handle member 61, the "plane" of engagement of the handle member 61 and stop surface 79 defines an absolute neutral position, as long as the adjustment of the neutral adjustment screw 45 has been made correctly, to establish the correct rotational position of the spring plate 49 and movable stop surface 79.

It will be appreciated by those skilled in the art, from a review of the foregoing specification, that the present invention provides a neutral centering mechanism which is capable of returning the control shaft 33 to its absolute neutral position, after rotation of the control handle 61 in either direction from the neutral position. Furthermore, the ability of the neutral centering mechanism to return the control shaft to its absolute neutral position is in no way dependent upon maintaining manufacturing tolerances of any of the parts of the centering mechanism 15. Instead, once the position of the adjustment screw 45 is set, to provide the absolute neutral position of the movable stop surface 79, the control shaft 33 will return to the absolute neutral position with a predictability and repeatability not previously known in the prior art.

The invention has been described in great detail, sufficient to enable one skilled in the art to make and use the same. Various alterations and modifications of the invention will occur to those skilled in the art upon a reading and understanding of the foregoing specification, and it is intended to include all such alterations and modifications as part of the invention, insofar as they come within the scope of the appended claims.

I claim:

1. A variable displacement hydraulic device of the type including a fluid displacement mechanism and means operable to vary the displacement of the displacement mechanism in response to rotation of a control shaft, about its axis of rotation, from a neutral position to a first operating position and from the neutral position to a second operating position; a control handle rotatably fixed to the control shaft whereby rotational actuation movement of said control handle about said axis of rotation results in corresponding rotation of said control shaft; a neutral centering mechanism operable to return said control handle and control shaft to the neutral position in the absence of actuation movement of said control handle; characterized by said neutral centering mechanism comprising:

(a) a stop plate;

(b) a spring plate rotatable about said axis of rotation, disposed adjacent said control handle, and defining a movable stop surface, disposed to be in engagement with said control handle in the absence of actuation movement of said control handle;

(c) one of said stop plate and said spring plate including a selectively movable adjustment member operable to be in engagement with the other of said stop plate and said spring plate, and one of said stop plate and said adjustment member defining a fixed stop surface;

(d) said adjustment member being operable to adjust the rotational position of said spring plate about said axis of rotation to a position in which said movable stop surface is disposed for neutral centering of said control handle and said control shaft;

(e) first biasing means associated with said spring plate and with said control handle, and operable to bias said control handle toward said movable stop surface when said control handle has been rotated away from said movable stop surface to said first operating position; and (f) second biasing means associated with said stop plate and with said spring plate, and operable to bias said spring plate toward said fixed stop surface when said control handle has been rotated away from said neutral position to said second operating position, thereby causing said spring plate to rotate away from said fixed stop surface.

2. A variable displacement hydraulic device as claimed in claim 1 characterized by rotation of said control handle from said neutral position to said first operating position, and from said neutral position to said second operating position defines a handle plane disposed generally perpendicular to said axis of rotation.

3. A variable displacement hydraulic device as claimed in claim 2 characterized by said movable stop surface being oriented generally perpendicular to said handle plane.

4. A variable displacement hydraulic device as claimed in claim 3 characterized by said engagement of said control handle and said movable stop surface being disposed such that rotation of said control handle from said neutral position to said second operating position results in said control handle and said spring plate rotating together, with said control handle maintaining engagement with said movable stop surface.

5. A neutral centering mechanism operably associated with a control shaft which is rotatable about an axis of rotation, from a neutral position to a first operating position, and from the neutral position to a second operating position; a control handle rotatably fixed to the control shaft whereby rotational actuation movement of the control handle about the axis of rotation results in corresponding rotation of the control shaft; said neutral centering mechanism being operable to return the control handle and control shaft to the neutral position from either the first operating position or the second operating position; characterized by:

(a) means defining a fixed stop surface;

(b) a spring plate rotatable about said axis of rotation, disposed adjacent said control handle, and defining a movable stop surface;

(c) said spring plate including a portion thereof being in engagement with said fixed stop surface;

(d) the rotational position of said spring plate, about said axis of rotation, being adjustable to a position in which said movable stop surface is disposed for neutral centering of said control handle and said control shaft;

(e) first biasing means associated with said spring plate and with said control handle, and operable to bias said control handle toward said movable stop surface when said control handle has been rotated away from said movable stop surface to said first operating position; and (f) second biasing means associated with said spring plate, and operable to bias said spring plate toward said fixed stop surface when said control handle has been rotated away from said neutral position to said second operating position, thereby causing said spring plate to rotate away from said fixed stop surface.

6. A neutral centering mechanism as claimed in claim 1 characterized by rotation of said control handle from said neutral position to said first operating position and from said neutral position to said second operating position defines a handle plane disposed generally perpendicular to said axis of rotation.

7. A neutral centering mechanism as claimed in claim 6 characterized by said movable stop surface being oriented generally perpendicular to said handle plane.

8. A neutral centering mechanism as claimed in claim 7 characterized by said engagement of said control handle and said movable stop surface being disposed such that rotation of said control handle from said neutral position to said second operating position results in said control handle and said spring plate rotating together, with said control handle maintaining engagement with said movable stop surface.

* * * * *